US006231270B1

(12) United States Patent
Cacossa

(10) Patent No.: US 6,231,270 B1
(45) Date of Patent: May 15, 2001

(54) APPARATUS AND METHOD OF INSTALLING PILES

(76) Inventor: Frank Cacossa, 93 Martin Rd., Livingston, NJ (US) 07039

( * ) Notice: Subject to any disclaimer, the term of this patent is extended or adjusted under 35 U.S.C. 154(b) by 0 days.

(21) Appl. No.: 09/321,010

(22) Filed: May 27, 1999

(51) Int. Cl.[7] ..... E02D 7/24

(52) U.S. Cl. ..... 405/248; 405/232; 175/67; 175/71; 175/424

(58) Field of Search ..... 405/236, 243, 405/237, 248, 233, 232, 249; 175/417, 418, 67, 71, 215, 212, 424; 173/73; 239/124, 125, 270, 548, DIG. 13, DIG. 21

(56) References Cited

U.S. PATENT DOCUMENTS

| | | | | |
|---|---|---|---|---|
| 822,588 | * | 6/1906 | Cummings | 405/243 |
| 903,126 | * | 11/1908 | Beall, Jr. | 405/233 |
| 950,360 | * | 2/1910 | Welsh | 405/233 |
| 1,063,942 | * | 6/1913 | Phillips | 405/248 |
| 1,173,355 | * | 2/1916 | Jones | 405/248 |
| 1,435,144 | * | 11/1922 | Bignell | 405/248 |
| 2,969,846 | * | 1/1961 | Sandvig | 175/418 |
| 3,289,421 | * | 12/1966 | Hindman | 405/228 |
| 3,664,139 | | 5/1972 | Sexauer | 61/53.74 |
| 3,674,100 | * | 7/1972 | Becker | 175/69 |
| 3,916,634 | * | 11/1975 | Woodruff | 405/248 |
| 3,917,007 | * | 11/1975 | Tsiferov | 175/67 X |
| 4,494,613 | | 1/1985 | Tamaki et al. | 173/74 |
| 4,637,758 | | 1/1987 | Tamaki et al. | 405/248 |
| 4,765,416 | * | 8/1988 | Bjerking et al. | 175/71 |
| 4,842,447 | | 6/1989 | Lin | 405/243 |
| 4,850,440 | * | 7/1989 | Smet | 175/67 |
| 5,016,717 | * | 5/1991 | Simons et al. | 175/66 |
| 5,137,394 | | 8/1992 | Tateno et al. | 405/232 |
| 5,380,124 | | 1/1995 | Cacossa et al. | 405/16 |
| 5,435,628 | | 7/1995 | Montgomery et al. | 299/17 |
| 5,435,668 | | 7/1995 | Shibazaki et al. | 405/233 |
| 5,484,233 | | 1/1996 | Kunito | 405/240 |
| 5,501,550 | | 3/1996 | Calabrese | 405/232 |
| 5,951,207 | * | 9/1999 | Chen | 405/232 |

* cited by examiner

*Primary Examiner*—William Neuder
*Assistant Examiner*—Sunil Singh
(74) *Attorney, Agent, or Firm*—Lerner, David, Littenberg, Krumholz & Mentlik, LLP

(57) ABSTRACT

A method and apparatus for creating a hole in a soil body. The apparatus includes an open ended tube, a conduit with a nozzle is arranged within the tube. The nozzle has a downwardly facing opening for applying a stream of compressed air downwardly below the bottom open end of the tube to impact the soil. The nozzle also has an upwardly facing opening for simultaneously applying a stream of compressed air upwardly toward the top open end of the tube to facilitate removal of soil particles. This apparatus is utilized to create a hole in which a pile may be installed.

17 Claims, 5 Drawing Sheets

APPARATUS AND METHOD OF INSTALLING PILES

FIELD OF THE INVENTION

The present invention relates to devices and methods of creating holes in soil. The present invention also relates to devices and methods for installing piles.

BACKGROUND OF THE INVENTION

Piles are used in many different applications. For example, piles are used to support buildings, docks, piers and other structures. Piles are also used to secure boats and locate desired sites.

U.S. Pat. No. 5,380,124 discloses a beach stabilizer system for building layers of sand on a beach and minimizing erosion of the beach. An important aspect of that system includes piles arranged at spaced intervals. The piles may be used to locate and literally retain discs associated with the beach stabilizer system and may also be used to facilitate vertical adjustment of such discs. It is explained in the '124 patent that the piles may be installed by being driven to a sufficient depth beneath the surface of the ground through the use of a front end loader and water jets.

U.S. Pat. No. 3,664,139 discloses a removable "self-jetting pile". The pile disclosed in the '139 patent is made of concrete. The decent of the pile through soil is facilitated by the use of water jets.

It is also known to use augers or other sophisticated equipment to create holes in which piles will be arranged. For example, U.S. Pat. No. 4,637,758 discloses a method of driving hollow piles into the ground where an auger is utilized for excavating soil. When the excavated soil is lifted to a desired position, compressed air is utilized to force the excavated soil out of an associated hollow pile.

In certain applications, it is desirable for piles to be weight bearing devices (e.g., supporting buildings or docks), while other applications may require piles for lateral support (e.g., boat slips and jetty markers) but do not require a weight bearing function. Hollow piles can be efficiently installed in certain environments where a weight bearing function is not a requirement. Such an application is disclosed, for example, in the '124 patent where the piles may be used as part of a beach stabilizer system.

In other applications where a weight bearing function is required, hollow piles may be installed and subsequently reinforced with a filler material, such as concrete or the like.

Regardless of the intended use of the piles, it has been inefficient prior to the present invention to create holes in which piles may be installed. The present invention solves the problems of the prior art by providing a highly efficient and effective method and apparatus for creating a hole in soil and optionally installing a pile in such hole.

SUMMARY AND OBJECTS OF THE INVENTION

One aspect of the present invention is directed to a method of creating a hole in soil. The method may comprise the step of providing a tube including a body having an open bottom end, an open top end and a passageway extending between the open bottom and top ends. The open bottom end of the tube may be arranged substantially adjacent to a site where it is desired to create a hole. A stream of compressed air may then be applied below the open bottom end of the tube such that the compressed air stream impacts soil at the site and forces the soil upward through the passageway of the tube and out of the open top end thereof until a hole of the desired depth is obtained.

Preferably, a conduit is arranged between the open bottom and top ends of the tube and is used to transport the compressed air through the tube. In such a preferred embodiment, the method may further comprise the step of guiding the tube downwardly into the hole as it is being created. The method may also comprise the step of simultaneously applying the compressed air stream downwardly and upwardly through a nozzle arranged near the open bottom end of the tube to facilitate removal of the soil particles through the open top of the tube. After a hole of the desired depth is created, it is preferable to remove the conduit through which the compressed air is permitted to flow from the tube. In certain embodiments, it may also be desirable for the method to comprise the step of removing the tube from the hole. In one such embodiment, the method may comprise the step of arranging a solid pile within the hole.

In another preferred embodiment, where the tube is maintained in the hole, the method may comprise the step of placing filler material within the passageway of the tube. In such an embodiment, the once hollow tube may be converted to a substantially solid tube.

In an embodiment where it is desired for a pile to have a weight bearing function, the filler material placed in the tube may be concrete. The concrete may be permitted to form a base at the bottom of the hole below the open bottom end of the once hollow tube.

In another preferred embodiment, the filler material may comprise soil. In other preferred embodiments, the filler material may comprise rocks or substantially any other substance capable of reinforcing the tube as it is filled.

The method preferably comprises creating the hole only upon application of compressed air. Thus, it is not necessary to utilize heavy equipment, augers or water jets when creating a hole in accordance with the preferred method.

The method may also comprise removing water from the hole if the hole extends into the water table. This may be accomplished by first discontinuing the application of the stream of compressed air when the hole is at a desired depth. A vacuum source can then be applied to a conduit in order to remove water encountered during creation of the hole. The vacuum source may be maintained as long as necessary in order to remove water from the hole and maintain the hole in a substantially water-free state.

Another aspect of the present invention relates to an apparatus for creating a hole in soil. The apparatus may comprise a tube including a body having an open bottom end, an open top end and a passageway extending between the open bottom and top ends. A compressed air source including a conduit and a nozzle may also be provided. In this preferred embodiment, at least a portion of the conduit is arranged within the tube, and the nozzle includes a downwardly facing opening for applying a stream of compressed air downwardly below the open bottom end of the tube so that soil is impacted by compressed air at a selected site. The nozzle also preferably has at least one upwardly facing opening for applying a stream of compressed air upwardly toward the open top end of the tube in order to facilitate removal of soil particles through the open top end.

Preferably, the nozzle of the present apparatus comprises a plurality of upwardly facing openings. The plurality of upwardly facing openings may be equally spaced from each other around the top of the nozzle.

In a preferred embodiment, a spacing device may be provided between a portion of the conduit and an inner wall of the tube for maintaining the conduit at a desired position with respect to the inner wall. The spacing device is preferably secured to the conduit. In one preferred embodiment, the spacing device may include an outer diameter arranged in abutment with the inner wall of the tube.

In another preferred embodiment, the apparatus may comprise an anchor device secured at the open top end of the tube where a portion of the conduit is secured to the anchor device. The anchor device may comprise a hollow cap mounted to the open top end of the tube, a cross bar extending through the hollow cap and a clamp in which the conduit is secured. It is preferable for the nozzle to be connected to the conduit at a location below the open bottom end of the tube. However, the present invention also contemplates arranging the nozzle at a location above or even with the open bottom end of the tube.

Accordingly, it is an object of the present invention to provide an efficient method and apparatus for creating a hole in soil. It is another object of the present invention to provide a method and apparatus for installing a pile within the hole.

Piles installed through the method and apparatus of the present invention may be hollow or solid. The piles may initially be hollow, and may later by converted to a solid pile through the use of filler materials such as concrete, soil, rocks, etc.

These and other objects of the present invention will be more fully understood with reference to the accompanying drawings and following detailed description.

DETAILED DESCRIPTION OF THE PREFERRED EMBODIMENTS

Figure 1:
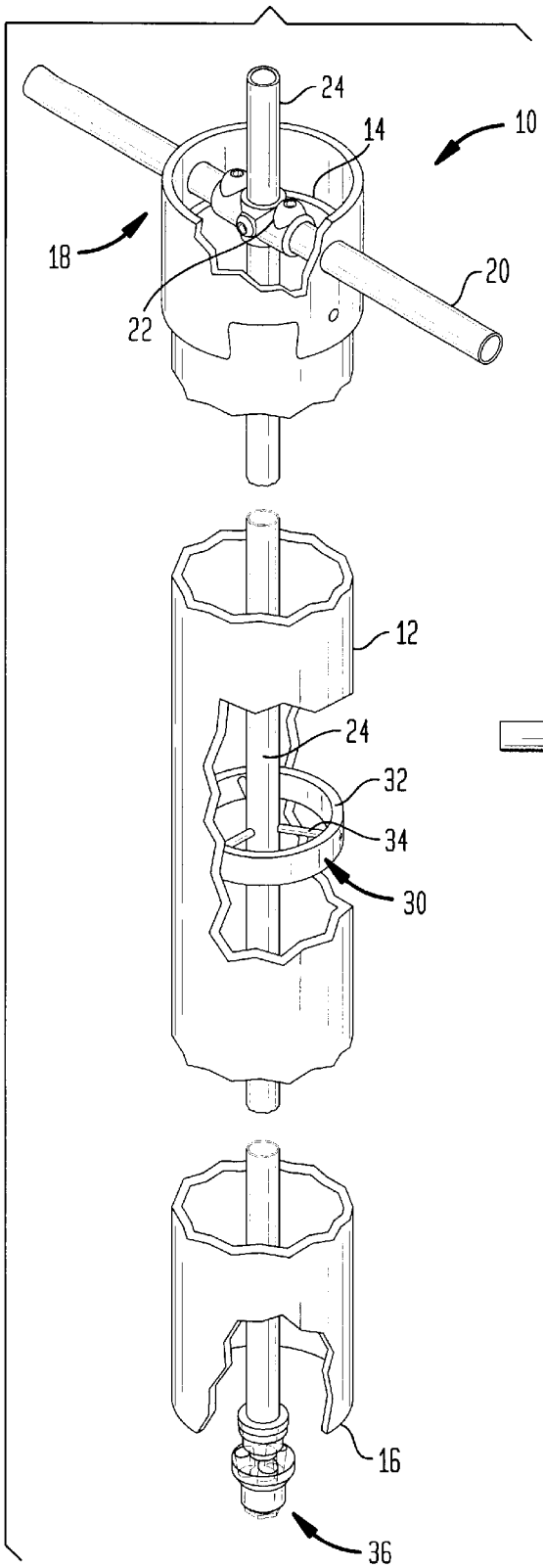
FIG. 1 is a partially broken away isometric view of the hole creating device of the present invention.
Figure 2:
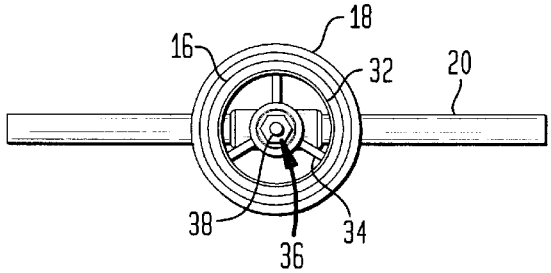
FIG. 2 is a bottom plan view of the hole creating device of the present invention.

FIGS. 1–5 illustrate a preferred embodiment of a hole forming device 10 and method of creating a hole in soil in accordance with the present invention. The hole creating device 10 is illustrated in FIG. 1 in an isometric partially broken away view so that the components thereof can be more fully appreciated than from a view where the components are hidden.

As used herein, it should be appreciated that the term "soil" is intended to broadly encompass various materials including sand, dirt, and other earth materials. Similarly, the term "compressed air" as used herein is intended to be broadly construed to cover a compressed source of any gas or a combination of gases such as air.

With reference to FIGS. 1, 3, 4 and 5, the hole creating device 10 includes a hollow pile 12 also referred to more generically herein as a tube. The hollow pile 12 includes an open top end 14, an open bottom end 16 and a passageway extending between and through the open top and bottom ends. The passageway can be fully appreciated from the drawings, but is not identified with a reference numeral.

The hollow pile 12 may be made of a wide variety of materials including polymers (such as PVC), metals, wood or various other materials. Depending upon a particular application, the hollow pile 12 may be retained in a hole after the hole is created, or it may be removed from the hole.

As shown in FIG. 1, the hole creating device 10 includes an anchor device (i.e., a conduit holding device) 18 secured to the open top end 14 of the hollow pile 12. In a preferred embodiment, the anchor device 18 is a tubular cap and may be secured at the open top end 14 of the hollow pile by a friction fit arrangement, or by cooperating threads, bolts, rivets or the like. A cross bar 20 extends through a pair of aligned holes (unnumbered) within the anchor device 18 and is used in conjunction with a clamp 22 to secure a conduit 24 for supplying compressed air into its assembled position.

Figure 3:
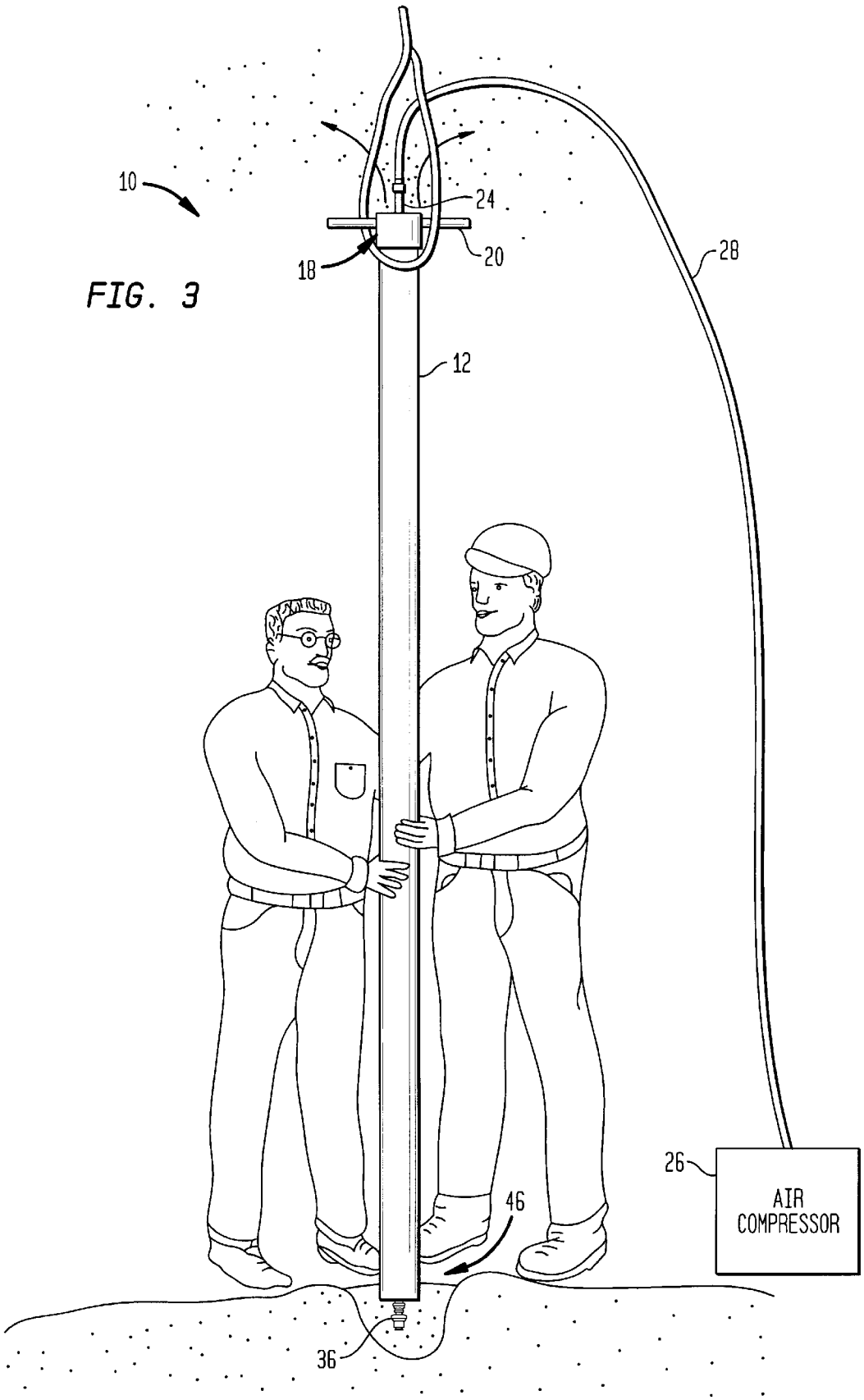
FIG. 3 is a front schematic view of the present invention when used in its intended environment to create a hole.
Figure 4:
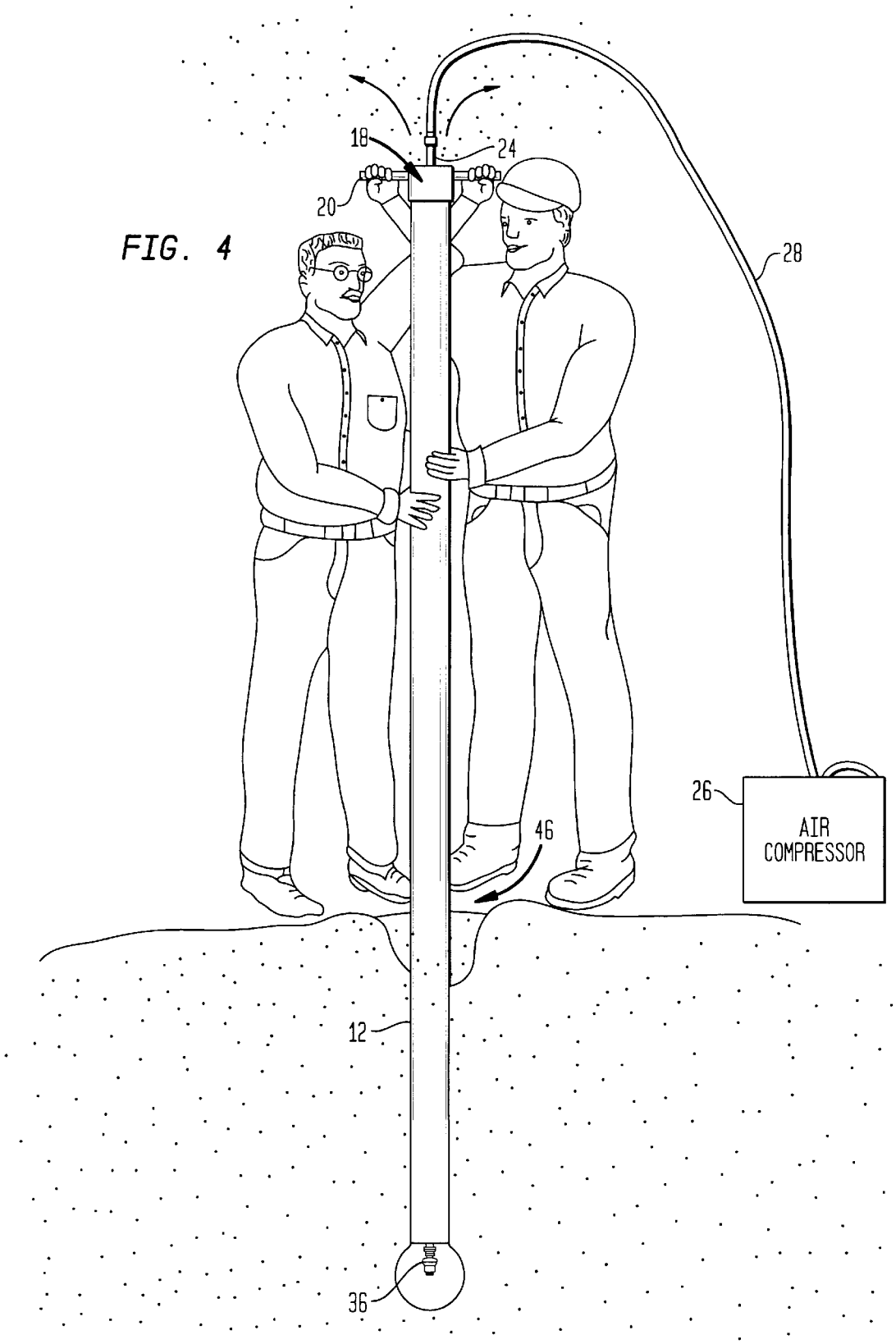
FIG. 4 is a front schematic view of the present invention when used in its intended environment to create a hole showing progress in accordance with the present method.

A compressed air source 26 is shown schematically in FIGS. 3 and 4 as part of a compressed air system for supplying compressed air through an associated flexible hose 28 and a more rigid conduit 24. In alternate embodiments, a single flexible hose may be used in place of a composite system including a rigid conduit.

As illustrated in FIG. 1, a spacing device 30 is used to help retain the conduit 24 in a central position within the hollow pile 12. The spacing device 30 includes a circular ring arranged in abutment with the inner wall of the hollow pile 12. The spacing device 30 also includes a plurality of spokes 34 secured to the conduit 24 to secure the conduit 24 in a desired central location within the hollow pile 12.

Figure 5:
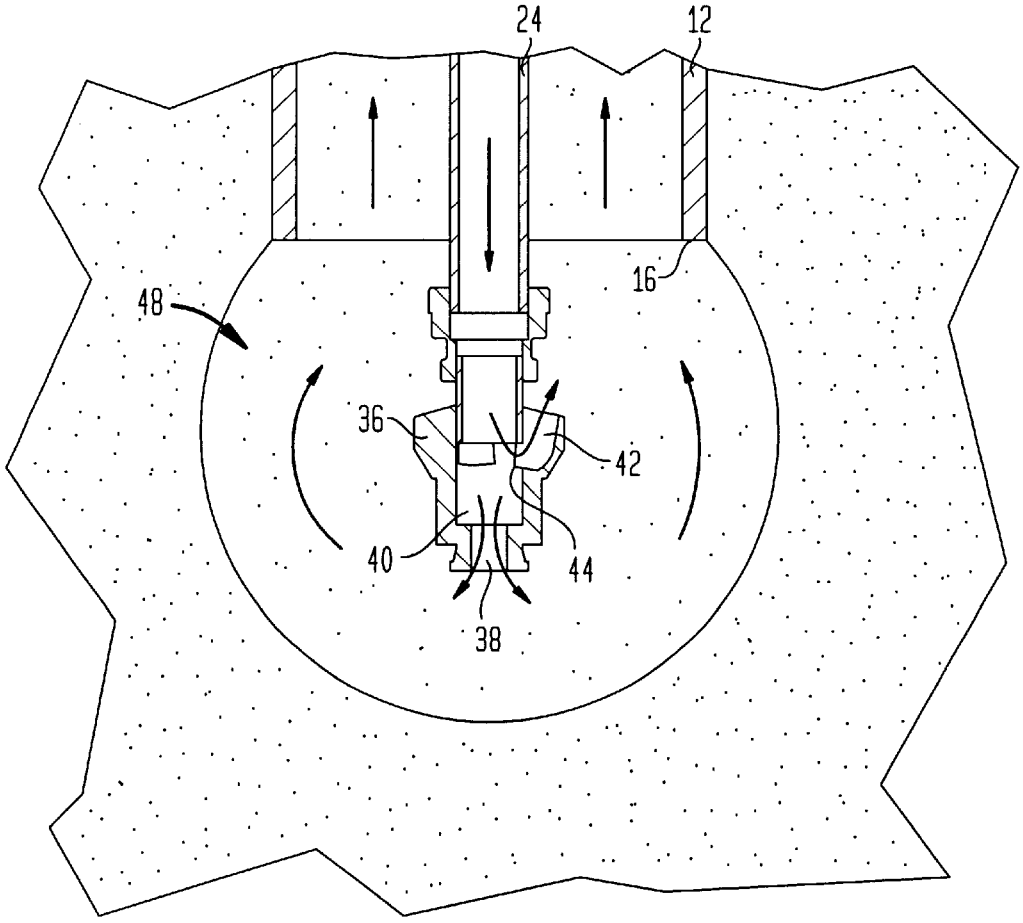
FIG. 5 is an isolated cross sectional view of a bottom section of the hole creating device of the present invention illustrating the formation of a hole.

An important aspect of the hole forming device 10 relates to the nozzle 36 which may be considered part of the compressed air system. The nozzle 36 includes a downwardly facing bottom hole 38 as shown in FIG. 5. The nozzle 36 also includes a plurality of top holes 42, one of which is shown in cross section in FIG. 5. Internally, the nozzle 36 includes a ledge, such as ledge 44 that is arranged to deflect air upwardly through the plurality of top holes 42. In a preferred embodiment, the nozzle 36 may include three of more holes 42 equally spaced around the top perimeter of the nozzle 36. In alternate embodiments, more or less than three top holes 42 may be utilized. As illustrated by the directional flow arrows shown in FIG. 5, the purpose of the top holes 42 is to direct a certain amount of compressed air upwardly so that soil particles initially disturbed by the compressed air stream through bottom hole 38 are forced upwardly through the passageway of the hollow pile 12 and out of the open top end 14 thereof.

Although the preferred embodiment of the nozzle 36 illustrates a single bottom hole 38, it should also be appreciated that the nozzle 36 may include multiple bottom holes which facilitate compressed air flow in various downward directions.

In a typical environment, the hollow pile 12 may have a passageway with a diameter of at least six inches and may be twelve feet in length. However, in alternate embodiments, the length and diameter of the piles may vary substantially. Thus, the passageway of the file may be more or less than six inches in diameter, and the length of the pile may be more or less than twelve feet.

An advantage of the hole forming device 10 of the present invention is that holes may be created without the use of any heavy equipment, often required for installation of prior art piles. As illustrated in FIGS. 3 and 4, the hollow pile 12 can easily be handled by two workers. However, more or less than two workers can use the present invention for creating a hole or for installing piles.

A desired site, such as site 46 of FIG. 3 should initially be selected. Compressed air source 26 should then be turned on so that a stream of compressed air is forced through the flexible hose 28, the conduit 24 and out of the bottom hole 38 of the nozzle 36. The required pressure of the air stream may vary depending upon a particular application. In one application where piles are being installed in sand, typical air pressures may range between 100–500 PSI. However, air pressures outside of this range can effectively be used to create a hole in accordance with the present method and apparatus.

As the pressurized air impacts the soil at site 46, it immediately begins to remove soil and create a hole. In the preferred embodiment shown in FIGS. 1, 3, 4 and 5, the nozzle 36 extends slightly below the open bottom end 16 of hollow pile 12. This is desirable to allow soil that has been disturbed by the stream of pressurized air from the bottom hole 38 of the nozzle 36 to flow into the open bottom end 16 of the hollow pile 12 where it is then forced out of the open top end 14 thereof by the streams of compressed air that flow through the plurality of top holes 42 of the nozzle 36. However, it should be appreciated that in alternate embodiments, the nozzle 36 need not extend below the open bottom end 16 of the hollow pile. In such alternate embodiments, the nozzle 36 may be arranged entirely within hollow pile 12 either even with or above the open bottom end 16 thereof.

FIG. 4 illustrates the hole forming device 10 as it is being used to create a hole in accordance with the method of the present invention. In particular, as the soil continues to flow out of the open top end 14 of the hollow pile 12, the workers may lower the hole forming device 10 into the hole being formed. The bottom-most portion of the hole may become enlarged if the hole forming device 10 is left at a particular location for an extended period of time. FIG. 5 particularly illustrates a slightly enlarged area 48 formed at the bottom of the hole when the hole forming device 10 is kept at the desired location for an extended period of time. The formation of such an enlarged area 48 may be desirable where a pile is to be utilized as a weight bearing structure as discussed further below.

As can be appreciated, when the hole forming device 10 is used to create a hole in which a pile is arranged on a beach, it is common for water to be encountered as the depth of the hole increases. The structure and operation of the hole forming device 10 is such that compressed air is the only external force needed to remove wet sand and water encountered during creation of a hole. It may be necessary in certain applications to increase the pressure of the associated compressed air source after wet conditions are encountered. This will depend on various factors such as the length and diameter of the pile, and the composition of the soil.

If it is desired to remove water encountered when the hole extends below the water table, a user can simply disconnect the compressed air source and replace it with a vacuum source (not shown). When the vacuum source is connected to the conduit 24, water which accumulates in the created hole, would be removed through the bottom hole 38 and/or the top holes 42 of the nozzle 36. The vacuum source may be maintained as long as necessary in order to remove water from the created hole or to maintain the hole in a substantially water-free state.

Piles used for the purpose of retaining beach erosion discs in assembled position in accordance with the disclosure in U.S. Pat. No. 5,380,124 need not perform any weight bearing function. Thus, after a hole having a desired depth is formed, an associated hollow pile 12 may be retained within the hole. It may be closed with a cap device (not shown) or filled with a filler such as sand, concrete, or the like. Only the hollow pile 12 itself should be left within the hole. Thus, the conduit 24 including the spacer device 30 should be removed along with the conduit holding device 18 and the cross bar assembly 20. These components can then be reused to install another hollow pile or create a hole for another purpose at a different selected site.

If it is desired to use a pile as a weight bearing structure, concrete may be poured through the open top end of the hollow pile 12. The concrete should be permitted to flow out of the open bottom end 16 of the hollow pile 12 so that it substantially fills the enlarged area 48 at the bottom of the hole. Thus, the concrete would effectively form a base for bearing weight after the pile 12 is filled with concrete or other filler material.

Figure 6:
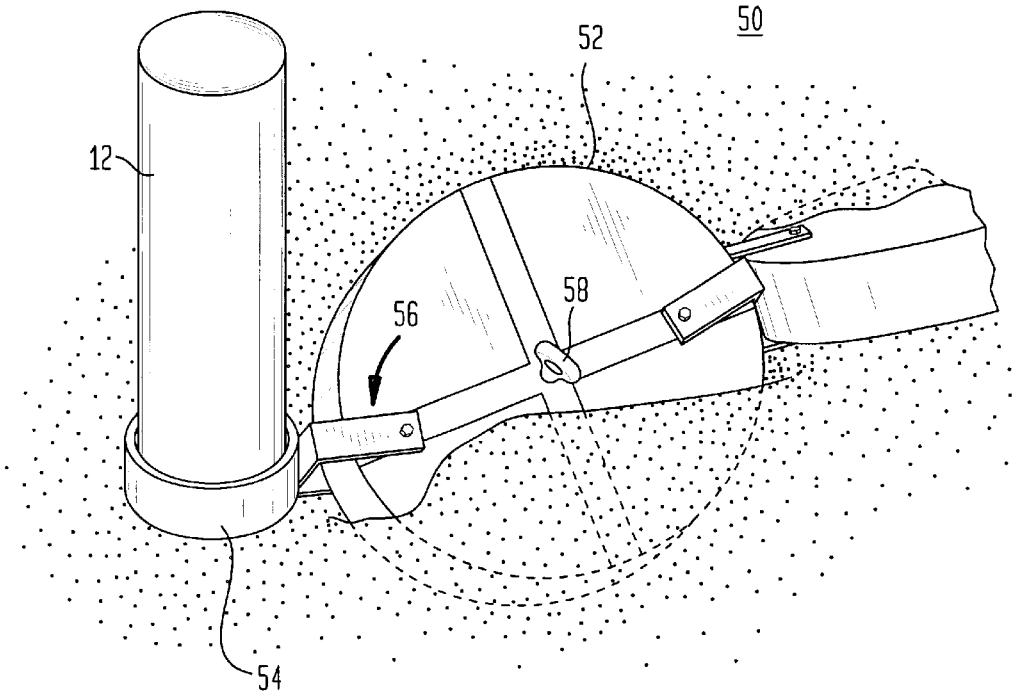
FIG. 6 is an isometric view of a beach stabilizer system including a pile installed by the present method.

FIG. 6 illustrates use of the pile 12 (after it has been capped or filled) as part of an erosion control system 50. The portion of the erosion control system 50 shown is similar to the beach stabilize system disclosed in the '124 patent. As such, the erosion control system 50 includes a concrete disc 52, a collar 54 arranged about the pile 12, a link 56 securing the collar 54 to the disc 52, and a lifting pin 58 which may be used by a crane or other lifting device for positioning the disc 52.

While the foregoing description and figures are directed toward preferred embodiments of the present method and apparatus, it should be appreciated that numerous modifications can be made to the components of the apparatus and to the method of creating a hole in soil and installing a pile. In fact, modifications are encouraged to be made in the materials, structure, arrangement and steps of the disclosed embodiments and methods of the present invention without departing from the spirit and scope of the same. Thus, the foregoing description of the preferred embodiments should be taken by way of illustration rather than by way of limitation as the present invention is defined by the following claims.

I claim:

1. A method of creating a hole in soil comprising the steps of:

providing a tube including a body having an open bottom end and an open top end and a passageway extending between said open bottom and top ends;

arranging the open bottom end of said tube substantially adjacent to a site where it is desired to create a hole; and applying a stream of compressed air below said open bottom end of said tube, wherein a conduit extending between said open bottom and top ends is used to transport said compressed air through said tube, such that said compressed air stream impacts soil at said site and simultaneously applying said compressed air stream downwardly and upwardly through a nozzle connected to said conduit to facilitate removal of said particles through said open top end of said tube, and moving said tube into said hole along with said conduit and said nozzle until a hole of the desired depth is obtained.

2. The method of claim 1 further comprising the step of removing said conduit from said tube when a hole of a desired depth is obtained.

3. The method of claim 2 further comprising the step of removing said tube from said hole.

4. The method of claim 3 further comprising the step of arranging a substantially solid pile within said hole.

5. The method of claim 2 further comprising the step of placing filler material within the passageway of said tube.

6. The method of claim 5 wherein said filler material comprises concrete.

7. The method of claim 5 wherein said filler material comprises soil.

8. The method of claim 5 wherein said filler material comprises rocks.

9. The method of claim 1 wherein said hole is created solely upon application of the compressed air forcing soil through said passageway of said tube and out of said open top end thereof.

10. The method of claim 1 further comprising the steps of discontinuing the application of the stream of compressed air; and applying a vacuum source to said conduit such that water encountered during creation of the hole is removed therefrom.

11. An apparatus for creating a hole in soil comprising:

a tube including a body having an open bottom end, an open top end and a passageway extending between said open bottom and open top ends; a compressed air assembly including a source of compressed air, a conduit and a nozzle connected to said conduit, at least one portion of said conduit being arranged within said tube, said nozzle having a downwardly facing opening for applying a stream of compressed air downwardly below said open bottom end of said tube to impact soil and create a hole at a selected site, said nozzle also having an upwardly facing opening for simultaneously applying a stream of compressed air upwardly through said open top end of said tube to facilitate removal of soil particles, wherein said tube is adapted to be moved into the hole alone with said conduit and said nozzle until the desired depth is obtained.

12. The apparatus of claim 11 wherein said nozzle comprises a plurality of upwardly facing openings.

13. The apparatus of claim 11 wherein said tube comprises an inner wall, said apparatus further comprising a spacing device arranged between said conduit and said inner wall of said tube for maintaining said conduit at a desired position with respect to said inner wall.

14. The apparatus of claim 13 wherein said spacing device is secured to said conduit.

15. The apparatus of claim 14 further comprising an anchor device secured at said open top end of said tube, said conduit being secured to said anchor device.

16. The apparatus of claim 15 wherein said anchor device comprises a hollow cap secured at said open top end of said tube, said anchor device further comprising a cross bar extending through said hollow cap and a clamp in which said conduit is directly secured.

17. The apparatus of claim 11 wherein said nozzle is arranged below said open bottom end of said tube.

* * * * *

UNITED STATES PATENT AND TRADEMARK OFFICE

CERTIFICATE OF CORRECTION

PATENT NO. : 6,231,270 B1
DATED : May 15, 2001
INVENTOR(S) : Frank Cacossa

It is certified that error appears in the above-identified patent and that said Letters Patent is hereby corrected as shown below:

Title page,
Item [57], delete the ABSTRACT and substitute therefor the following ABSTRACT:

-- A method and apparatus for creating a hole in soil. A hollow tube and a compressed air source is utilized to create a hole in which a pile may be installed. --

Column 8,
Line 6, delete “alone” and insert therefor -- along --.

Signed and Sealed this

Fifth Day of August, 2003

JAMES E. ROGAN
*Director of the United States Patent and Trademark Office*